US010584496B2

(12) United States Patent
Holland et al.

(10) Patent No.: US 10,584,496 B2
(45) Date of Patent: Mar. 10, 2020

(54) ROOF RIDGE VENT AND ASSOCIATED METHOD

(71) Applicant: AIR VENT, INC., Dallas, TX (US)

(72) Inventors: Robert B. Holland, Rowlett, TX (US); Grayson Griffin, Grand Prairie, TX (US); Rochelle D. Wellhausen-Grimm, Euless, TX (US)

(73) Assignee: AIR VENT, INC., Dallas, TX (US)

( * ) Notice: Subject to any disclaimer, the term of this patent is extended or adjusted under 35 U.S.C. 154(b) by 0 days.

(21) Appl. No.: 16/034,416

(22) Filed: Jul. 13, 2018

(65) Prior Publication Data

US 2020/0018071 A1 Jan. 16, 2020

(51) Int. Cl.
*E04D 13/17* (2006.01)
*F24F 7/02* (2006.01)

(52) U.S. Cl.
CPC ..... *E04D 13/174* (2013.01); *F24F 7/02* (2013.01)

(58) Field of Classification Search
CPC ..... E04D 13/174; E04D 13/176; F24F 7/02
USPC ..... 52/198; 454/365, 242, 250
See application file for complete search history.

(56) References Cited

U.S. PATENT DOCUMENTS 2,799,214 A * 7/1957 Roose ..... F24F 7/02 454/365
4,817,506 A * 4/1989 Cashman ..... E04D 13/174 454/365
4,957,037 A * 9/1990 Tubbesing ..... E04D 13/174 454/366
5,052,286 A * 10/1991 Tubbesing ..... E04D 13/174 454/365
5,095,810 A * 3/1992 Robinson ..... F24F 7/02 454/365
5,122,095 A * 6/1992 Wolfert ..... F24F 7/02 454/365
5,149,301 A * 9/1992 Gates ..... E04D 13/174 454/365
6,212,833 B1 * 4/2001 Henderson ..... E04D 13/172 454/365
6,233,887 B1 * 5/2001 Smith ..... E04D 13/176 52/198
6,260,315 B1 * 7/2001 Smith ..... E04D 13/176 454/365
6,277,024 B1 * 8/2001 Coulton ..... F24F 7/02 454/365
6,793,574 B1 * 9/2004 Robinson ..... E04D 13/174 454/364
7,662,037 B2 * 2/2010 Polston ..... E04D 13/174 454/365

(Continued)

*Primary Examiner* — Brent W Herring
(74) *Attorney, Agent, or Firm* — Eckert Seamans Cherin & Mellott, LLC

(57) ABSTRACT

A roof ridge vent comprises a body including inner and outer surfaces, first and second ends, and first and second sides. First and second edge portions disposed at or about the first and second sides, respectively, include vent openings for the passage of air and baffles for shielding the vent openings. A central portion is disposed between the first edge portion and the second edge portion. The central portion has a first height, and the body tapers as it extends laterally outward from the central portion to the first edge portion and second edge portion such that the first and second edge portions have a reduced height.

17 Claims, 9 Drawing Sheets

(56) References Cited

U.S. PATENT DOCUMENTS

| | | | | |
|---|---|---|---|---|
| 7,766,735 | B2 * | 8/2010 | Ciepliski | F24F 7/02 454/365 |
| 7,814,715 | B2 * | 10/2010 | Coulton | F24F 7/02 454/364 |
| D654,161 | S | 2/2012 | Holland et al. | |
| 8,790,167 | B2 | 7/2014 | Holland et al. | |
| 8,935,895 | B2 * | 1/2015 | Mankowski | E04D 13/174 454/365 |
| 9,540,823 | B2 * | 1/2017 | Mankowski | E04D 13/176 |
| 9,695,594 | B2 * | 7/2017 | Van Wey | E04D 13/176 |
| 9,890,965 | B2 | 2/2018 | Holland et al. | |
| 10,233,650 | B2 * | 3/2019 | Fiser | E04D 13/174 |
| 2007/0072540 | A1 * | 3/2007 | Ciepliski | E04D 13/174 454/365 |
| 2008/0287054 | A1 * | 11/2008 | Carlson | E04D 13/174 454/365 |
| 2009/0025316 | A1 * | 1/2009 | Coulton | E04D 13/176 52/199 |
| 2009/0049769 | A1 * | 2/2009 | Kaseda | E04D 13/174 52/198 |
| 2011/0195655 | A1 * | 8/2011 | Holland | E04D 13/174 454/365 |
| 2014/0273808 | A1 * | 9/2014 | Mankowski | E04D 13/176 454/365 |
| 2014/0308891 | A1 * | 10/2014 | Holland | E04D 13/174 454/365 |
| 2016/0201332 | A1 * | 7/2016 | Fiser | E04D 13/174 454/365 |
| 2016/0215500 | A1 * | 7/2016 | Van Noort | E04D 13/174 |
| 2016/0369513 | A1 * | 12/2016 | Van Wey | E04D 13/176 |

* cited by examiner

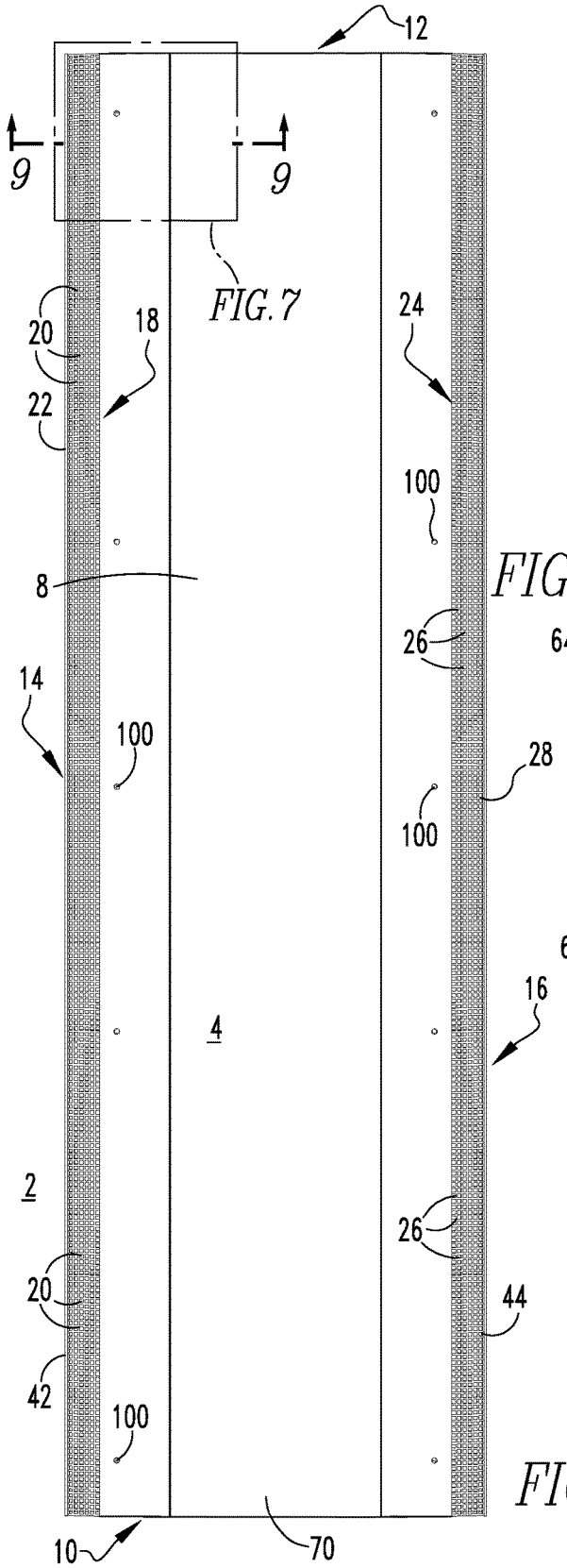
12
9
9
FIG.7
20
18
22
24
100
8
26
14
100
28
100
4
16
2
26
20
44
42
100
10
70
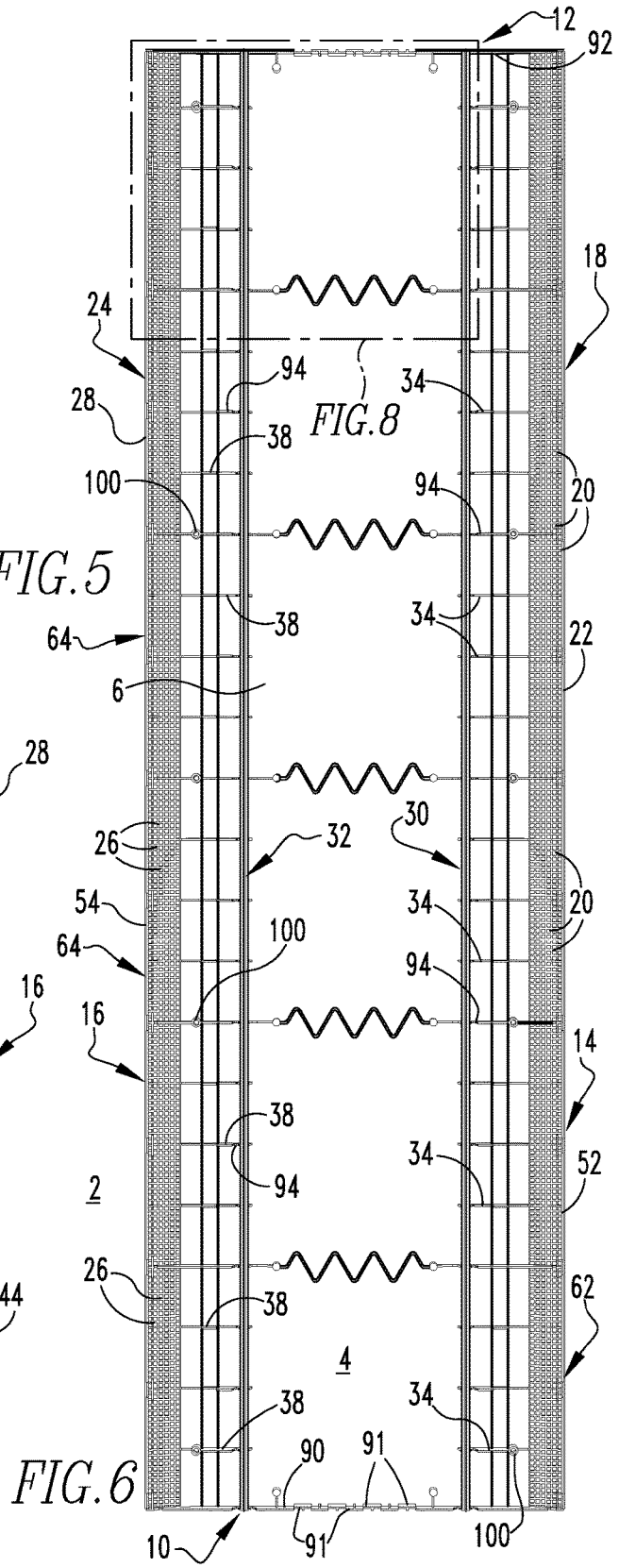
12
92
18
24
24
94
34
28
38
FIG.8
100
94
20
FIG.5
8
38
34
64
22
6
28
30
26
32
54
34
20
64
100
94
16
16
14
38
34
52
2
94
2
26
26
38
62
4
38
34
90
91
FIG.6
10
91
100

ROOF RIDGE VENT AND ASSOCIATED METHOD

BACKGROUND

Field

The disclosed concept relates generally to vents and, more particularly, to roof ridge vents for ventilating the roof of a structure such as, for example, a building. The disclose concept also relates to a method of nesting a plurality of roof ridge vents.

Background Information

Vents are commonly employed on the roofs of structures, such as residential buildings, commercial buildings and other structures, in order to exhaust air from beneath the roof (e.g., from an attic space) into the surrounding atmosphere, and to remove unwanted moisture.

For example, a variety of passive roof vents have been employed at various locations on building roofs in an attempt to release heat which can undesirably build up and become trapped under the roof. Passive vents provide an air passageway for such hot air to be exhausted from the roof, and thereby help to maintain a relatively comfortable temperature within the building. More specifically, by releasing unwanted hot air, a lower average temperature can be maintained without requiring excessive energy to be expended to cool the air, for example, by air-conditioning. The vents serve to stimulate natural convection of the air by releasing the hot air which has risen to the roof and, in turn, drawing and circulating cooler air, which is more dense and thus resides in relatively low-lying areas, throughout the building. Such vents also serve a safety function, as excessive heat can result in damage to the roof, and could potentially cause a fire. This is particularly important in warm climates where the roof is exposed to excessive and prolonged heat and sunlight. In cooler climates, venting the attic space serves to exhaust undesirable moisture-laden attic air, in order to prevent damage to the internal structure. It will be appreciated, therefore, that roof vents not only function to eradicate unwanted heat and/or moisture from the roof assembly, but in doing so, also extend the life of the roof assembly and, in particular, roof shingles (e.g., without limitation, asphalt shingles).

A ridge vent, for example, is employed at the peak or ridgeline of the roof of a building and generally comprises a resilient elongated body structured to overlay an exterior surface (e.g., without limitation, shingles) at or about the roof ridgeline and to be covered by a plurality of finishing shingles. The ridge vent facilitates the aforementioned passive ventilation by providing passageways at the lateral edges, as well as passageways at the longitudinal ends of the elongated body through which air can circulate, as desired. Typically, the passageways at the lateral edges consist of a plurality of closely spaced slots and the passageways at the opposing ends consist of an arrangement of generally V-shaped members. Upturned shields or baffle members extend upwardly at the lateral edges to at least partially shield and/or create a baffle for the slots. However, a separate filter element (e.g., without limitation, screen, mesh) is typically required to avoid undesirable entry of relatively small particulate matter.

Generally, such ridge vents have been effective for ventilating traditional gable style roofs having a substantially straight ridgeline that runs the entire length of the roof at substantially the same elevation, all the way to the edge of the building, or slightly beyond the edge of the building. The upper course of shingles, near the peak of the roof, provides a relatively smooth and flat surface for the ridge vent to mount and conform to. Hip roofs, however, present a number of challenges. Specifically, unlike the aforementioned gable roof, the hip roof has hip ends which slope backwards and can result in a plurality of ridgelines being formed at different elevations. Consequently, a sloped ridgeline transition section is required between the ridgelines. These sloped areas create stair or stepped surfaces that can result in gaps between the base (e.g., first side) of the vent and the roof shingles. In order to resist weather and/or debris from entering through such gaps, extreme care must be used to close them. For example, prior designs use separate sealing members or sealant materials (e.g., without limitation, foam, caulk, resin) between the roof and the base of the vent. Use of such separate sealing members and/or materials can undesirably increase cost and complicate the manufacturing and installation processes. It can also cause disadvantages with respect to packaging and shipping of the roof vents.

In addition, it is desirable to minimize the roof vent vertical profile (e.g., height). That is, it is desirable to provide a relatively lower profile than prior art ridge vent designs in order to make the ridge vent less noticeable and thereby improve the aesthetic appearance of the roof. However, while it is desirable to reduce the height or vertical profile of the vent it is critical to maintain effective ventilating functionality. This requires careful design consideration to maintain proper net free area and air flow direction for effective passive air ventilation.

There is, therefore, room for improvement in roof ridge vents and associated methods.

SUMMARY

These needs and others are met by embodiments of the disclosed concept, which are directed to an improved roof ridge vent and associated method.

As one aspect of the disclosure concept, a roof ridge vent comprises: a body comprising an inner surface, an outer surface disposed opposite the inner surface, a first end, a second end disposed opposite and distal from the first end, a first side, and a second side disposed opposite and distal from the first side; a first edge portion disposed at or about the first side, the first edge portion including a plurality of first vent openings for the passage of air and a first baffle for shielding the first vent openings; a second edge portion disposed at or about the second side, the second edge portion including a plurality of second vent openings for the passage of air and a second baffle for shielding the second vent openings; a central portion disposed between the first edge portion and the second edge portion; wherein the central portion has a first height; and wherein the body tapers as it extends laterally outward from the central portion to the first edge portion and second edge portion such that the first and second edge portions have a reduced height.

As another aspect of the disclosed concept, a method is provided for nesting roof ridge vents. The method comprises: providing a first roof ridge vent comprising a body comprising an inner surface, an outer surface disposed opposite the inner surface, a first end, a second end disposed opposite and distal from the first end, a first side, and a second side disposed opposite and distal from the first side, providing a second roof ridge vent substantially similar to the first roof ridge vent, and bringing the roof ridge vents into contact until the first and second roof ridge vents nest together.

BRIEF DESCRIPTION OF THE DRAWINGS

A full understanding of the disclosed concept can be gained from the following description of the preferred embodiments when read in conjunction with the accompanying drawings in which:

FIG. 5 is a top plan view of the vent of FIG. 1;

FIG. 6 is a bottom plan view of the vent of FIG. 5;

DESCRIPTION OF THE PREFERRED EMBODIMENTS

Figure 1:
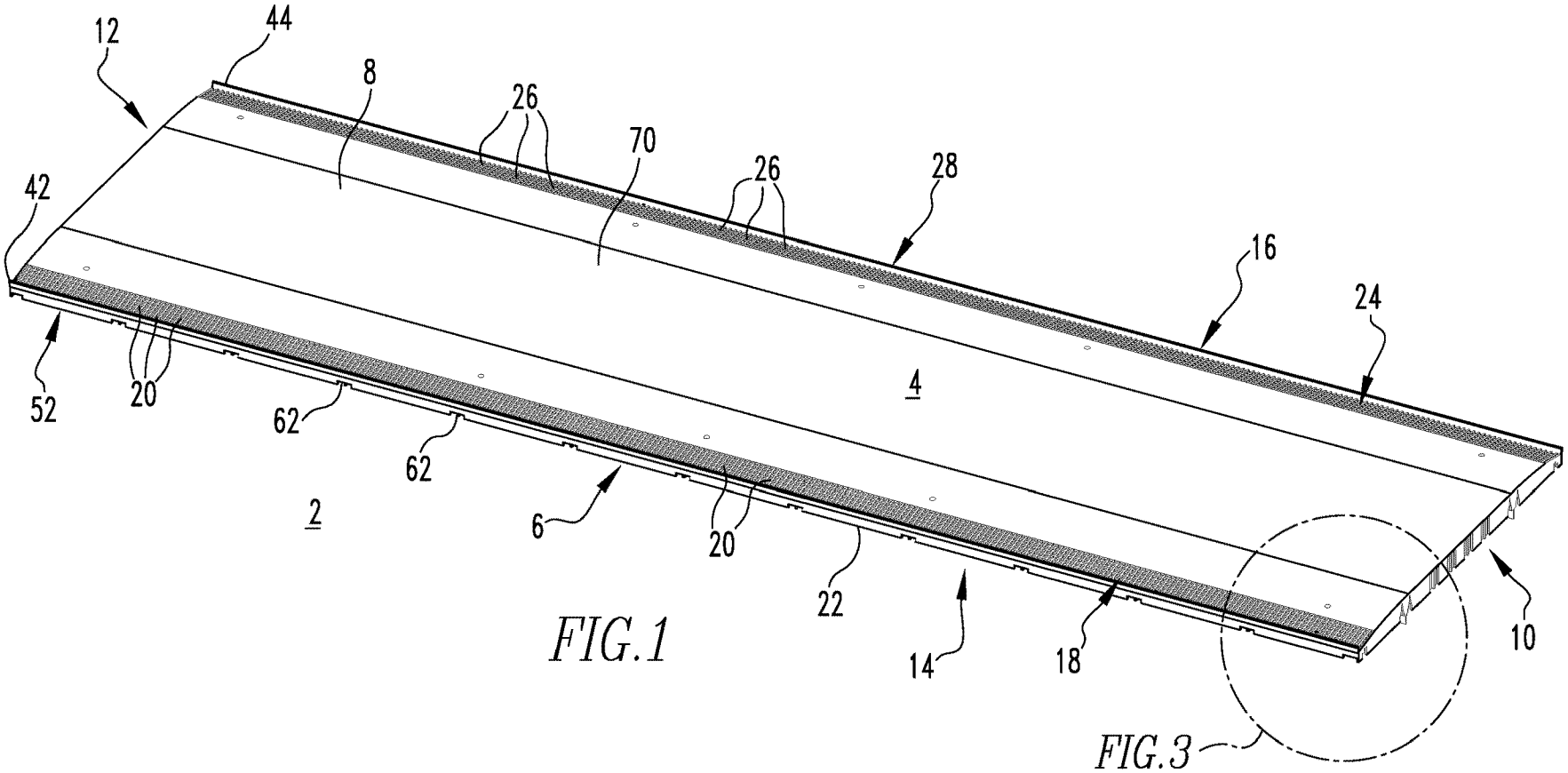
FIG. 1 is a top isometric view of a roof ridge vent in accordance with an embodiment of the disclosed concept.

It will be appreciated that embodiments of the disclosed concept may be applied with to ventilate any known or suitable type of roof (e.g., without limitation, gable style roofs; hip style roofs; roofs having a combination of hips and gables). Directional phrases used herein, such as, for example, up, down, in, out, top, bottom and derivatives thereof, relate to the orientation of the elements shown in the drawings and are not limiting upon the claims unless expressly recited therein.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

To the extent more than one substantially identical roof ridge vent is shown and described herein, it will be appreciated that the features of each vent are substantially identical and that like features shall be considered to be numbered similarly for all of the vents shown and described. For example, in one embodiment, there may be a first roof ridge vent 2 and a substantially identical second roof ridge vent 2'. If the first roof ridge vent 2 includes a body 4, it will be appreciated that the second roof ridge vent 2' likewise includes a substantially identical body 4'.

As employed herein, the terms "gable," "gable roof," "gable type," and "gable style" refer to a roof structure for a building or other structure wherein the peak or ridgeline of the roof extends to the edge of the building, or slightly beyond the edge.

As employed herein, the terms "hip," "hip roof," "hip type" and "hip style" refer to a roof structure for a building or other structure wherein the peak or ridgeline of the roof does not extend to the edge of the building, but rather stops short of the edge of the building and, therefore, includes a plurality of sloped portions.

As employed herein, the term "shingle" refers to any known or suitable type of roof finishing layer, expressly including, but not limited to asphalt shingles, slate shingles, as well as shingles made from any other known or suitable synthetic material.

As employed herein, the term "nest" refers to the fit or arrangement of two or more vents such that they occupy relatively minimal space when combined together.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
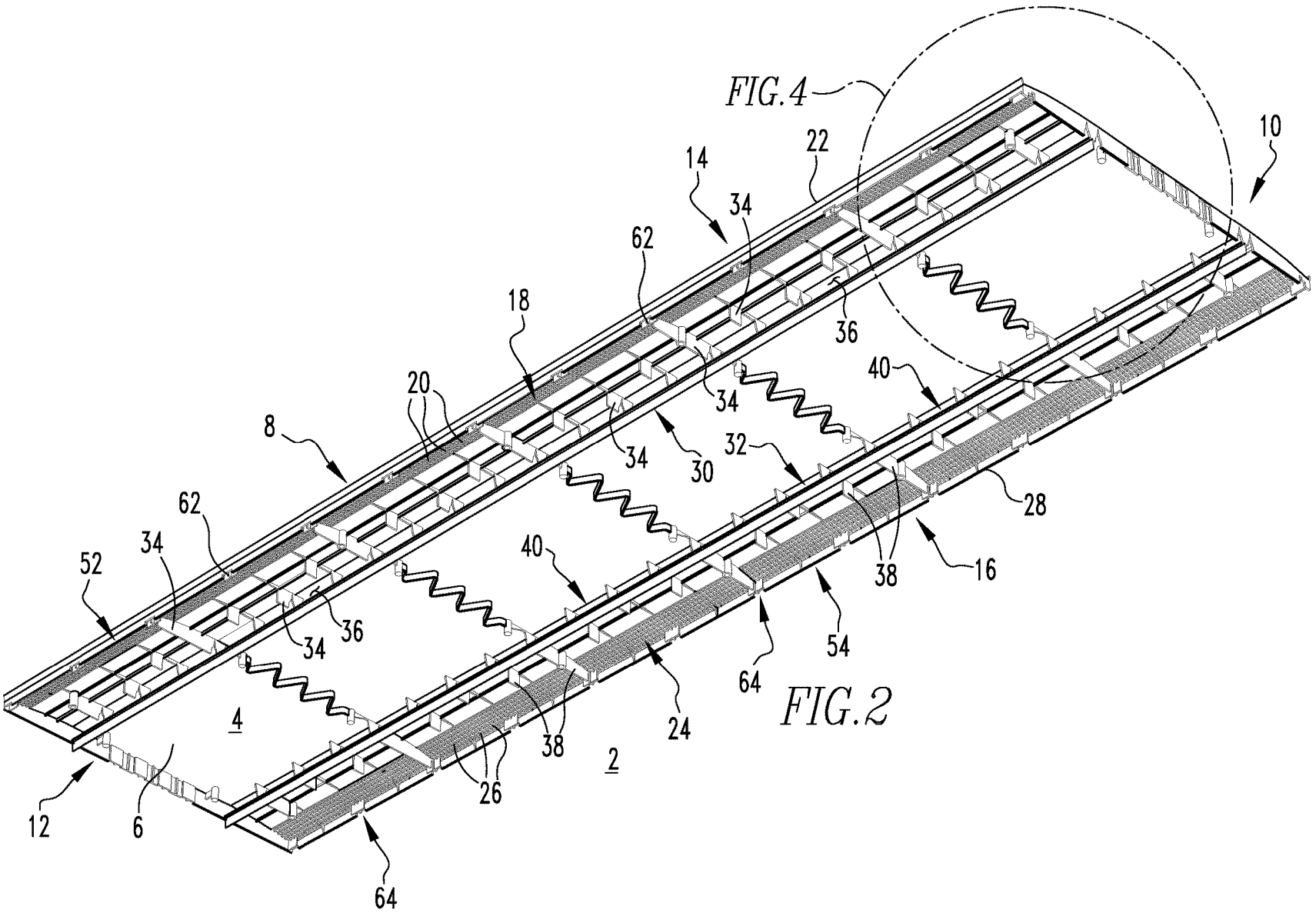
FIG. 2 is a bottom isometric view of the vent of FIG. 1.
Figure 3:
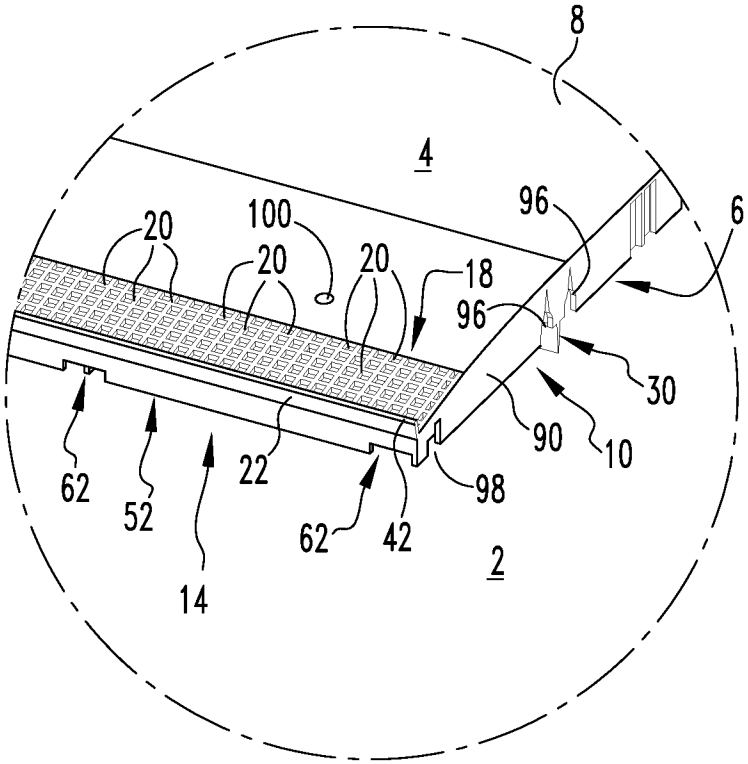
FIG. 3 is an enlarged top isometric view of a portion of the vent of FIG. 1.

FIGS. 1 and 2 show top and bottom isometric views, respectively, of an improved roof ridge vent 2 in accordance with the disclosed concept. In the non-limiting example shown, the roof ridge vent 2 includes a body 4 having an inner surface 6, an outer surface 8, first and second opposing ends 10,12, and first and second opposing sides 14,16. A first edge portion 18 is disposed at or about the first side 14 and includes a plurality of first vent openings 20 (best shown in the enlarged views of FIGS. 3 and 7) for the passage of air, and a first baffle 22 for shielding the first vent openings 20. A second edge portion 24 is disposed at or about the second side 16 of the vent body 4 and includes a plurality of second vent openings 26 substantially similar to the first openings 20. A second baffle 28 is structured to shield the second vent openings 26. In one non-limiting embodiment, the vent 2 is four feet long by fourteen inches wide by one inch tall. It will be appreciated, however, that the vent 2 and body 4 could have any known or suitable alternative dimension(s), without departing from the scope of the disclosed concept.

The plurality of first and second vent openings 20,26 are preferably, but not necessarily, arranged in a repeating geometric pattern. For example and without limitation, in the non-limiting embodiment shown and described herein, the first and second plurality of openings 20,26 comprise an array of closely-spaced square-shaped openings arranged in a symmetric pattern of aligned rows and columns (best shown, for example, in the enlarged views of FIGS. 7 and 8). Each of the vent openings 20,26 is substantially identical in shape (i.e., square) and size. For example and without limitation, in one non-limiting embodiment each of the square vent openings 20,26 preferably has a cross-sectional area of about 0.016 $in^2$. It will be appreciated, however, that the openings could comprise any known or suitable alternative size (not shown), shape (e.g., without limitation, circle; hexagon)(not shown), and/or geometric pattern (not shown), without departing from the scope of the disclosed concept. Among other advantages, the relatively small size and unique arrangement of the vent openings 20,26 in accordance with the disclosed concept advantageously function to effectively facilitate airflow while also resisting undesired entry of debris and/or animals. Moreover, because of the relatively small size and unique arrangement of the openings 20,26, the roof ridge vent 2 in accordance with the disclosed embodiment eliminates the requirement of prior art designs wherein a separate screen or filter element (not shown) was needed to comply with certain codes and regulations with respect to maximum permissible opening size in order to resist undesired entry of debris and/or animals.

Figure 9:
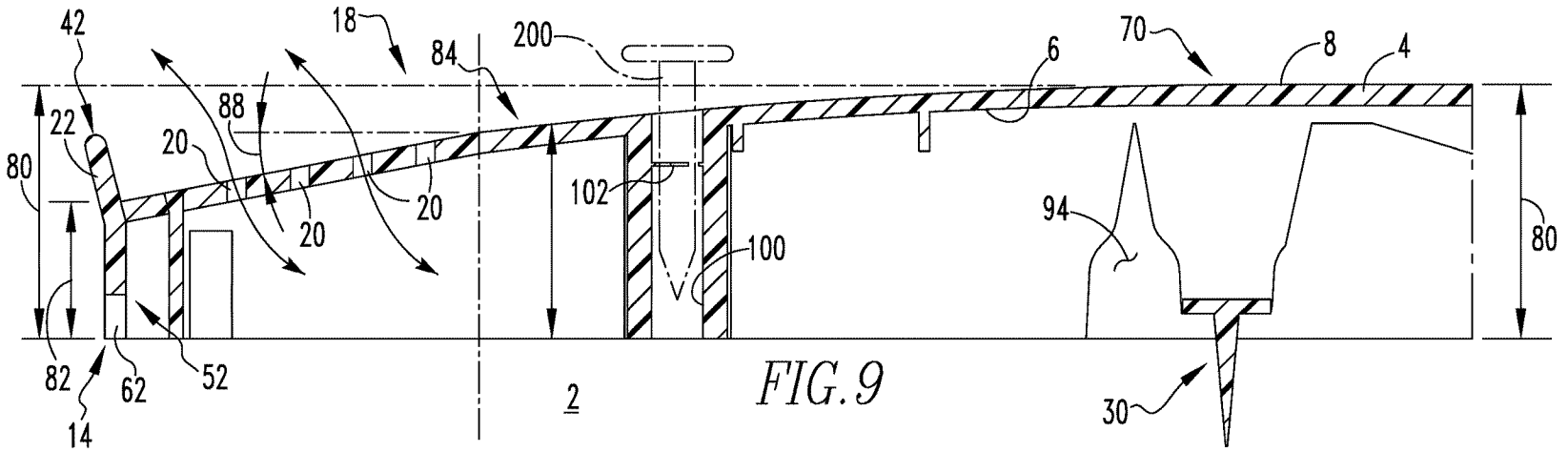
FIG. 9 is a section view taken along line 9-9 of FIG. 5.

Another unique feature of the exemplary vent openings 20,26 is that they are preferably oriented vertically, as best shown in the enlarged section view of FIG. 9. That is, when the vent body 4 is viewed from the uninstalled end elevation view perspective of FIG. 9, the fact openings 20 are oriented vertically, as shown. This orientation, as opposed to, for example, the openings instead extending perpendicularly through the first edge portion 18 of the vent body 4, provides a number of advantages. Among other benefits, the vertical orientation of the openings 20 forces airflow directly downwardly thereby improving airflow efficiency. Additionally, any water or moisture that may enter through the openings 20 is more readily removed because it is directed downward and outward toward a corresponding drainage hole (see, for example, drainage hole 62 in the base 52 of baffle 22 in FIG. 9).

As shown in FIGS. 2, 4, 6 and 8, the vent 2 preferably, although not necessarily, further includes first and second elongated sealing members 30,32 extending longitudinally substantially between the first and second ends 10,12 of the vent body 4. The elongated sealing members 30,32 function to provide an effective sealing interface between the roof (not shown) and vent 2, regardless of roof type (e.g., without limitation, gable, hip, combination of gable and hip). A plurality of first lateral protrusions 34 extends outwardly from the inner surface 6 of the vent body 4 at or about the first edge portion 18, and a plurality of second lateral protrusions 38 extend outwardly from the inner surface 6 of the vent body 4 at or about the second edge portion 24. The first elongated sealing member 30 transversely spans a number of the first lateral protrusions 34 to form an air gap 36 (best shown in the enlarged view of FIG. 4) between the first elongated sealing member 30 and the inner surface 6 of the vent body 4. Likewise, the second elongated sealing member 32 transversely spans a number of the second lateral protrusions 38 to form an air gap 40 (best shown in the enlarged view of FIG. 4) between the second elongated sealing member 32 and the inner surface 6 of the vent body 4. Such air gaps further enhance airflow and ventilation performance of the vent 2.

A further unique aspect of the disclosed roof ridge vent 2 is that it is designed to be made as one single piece of material such that it comprises one single unitary component. Preferably, the single unitary component is designed such that it can be made in one single manufacturing step (e.g., without limitation, injection molding). That is, unlike prior art designs where, for example, sealing elements such as elongated sealing members were required to be made separately as individual components and then subsequently attached to the vent body, or were made from a different material having different material properties than the rest of the vent body such that several manufacturing steps and separate materials were required, in accordance with the disclosed concept the entire vent 2, including the aforementioned vent openings 20,26 and elongated sealing members 30,32 comprise one single unitary component made from one single piece of the same material (e.g., without limitation, plastic). Accordingly, it will be appreciated that the disclosed roof ridge vent 2 is significantly more efficient and less expensive to manufacture than prior art designs.

The exemplary baffles 22,28 will now be described in greater detail with reference, for example, to FIGS. 1-6, 10 and 11. The first baffle 22 extends on from the first end 10 of the body 4 to the second end 12 of the body 4, and includes a first tip 42, which extends upward laterally outward with respect to the body 4 as best shown in the end elevation views of FIGS. 10 and 11. Likewise, the second baffle 28 also extends longitudinally between the first and second ends 10,12 of the body 4, and includes a second tip 44, which extends upward and laterally outward with respect to the body 4. The first and second tips 42,44 of the first and second baffles 22, 28, respectively, are preferably rounded (best shown in the enlarged section view of FIG. 9). This rounded profile advantageously serves to increase laminar airflow as compared to prior art designs having a squared off profile with sharp edges. That is, airflow tends to become disrupted and turbulent when passing over sharp edges or rough surfaces as opposed to laminar airflow over and around rounded or smooth surfaces.

As shown in FIGS. 2-4, 6 and 8, the first baffle 22 has a first base 52 disposed opposite the first tip 42, and the second baffle 28 has a second base 54 disposed opposite the second tip 44. The first and second bases 52,54, each include a plurality of drainage holes 62,64, respectively, that are preferably evenly spaced along the longitudinal length of the vent body 4, as shown in the bottom views of FIGS. 2 and 6. As previously discussed with respect to FIG. 9, such drainage holes 62,64 function to effectively remove or drain any water or moisture that may enter the vent body 4.

Referring to FIGS. 5, 7 and 9-11, it will be appreciated that the body 4 of the exemplary roof ridge vent 2 has a central portion 70, which is disposed between the first and second edge portions 18,24. As shown in the enlarged section view of FIG. 9, the central portion 70 has a first height 80 or thickness. The vent body 4 tapers or it gets narrower (i.e., thinner) as it extends laterally outward from the central portion 70 to the first and second edge portions 18,24. Accordingly, the first and second edge portions 18,24 have a reduced height 82 or thickness compared to the first height 80 or thickness of the central portion 70. Additionally, as best shown in the end elevation views of FIGS. 10 and 11, the vent body 4 further includes a first tapered portion 84, which is disposed between the first edge portion 18 and the central portion 70, and a corresponding second tapered portion 86, which is disposed between the second edge portion 24 and the central portion 70. These tapered portions 84,86 are generally planar and are disposed at an angle 88 (FIG. 9) to further taper or narrow the vent body 4 to achieve the reduced height 82 (FIG. 9) or thickness. In this manner, the roof ridge vent 2 is designed to have a relatively lower profile than prior art roof ridge vent designs. This is accomplished without adversely impacting net free area or passive ventilation performance of the vent 2. Accordingly, the disclosed roof ridge vent 2 is less noticeable when installed and, therefore, is more aesthetically pleasing than prior art designs yet it affords comparable or superior ventilation performance.

As shown in FIGS. 2, 4, 6 and 8, the aforementioned first and second lateral protrusions 34,38 preferably comprise a plurality of structural ribs. In accordance with another unique aspect of the disclosed concept, at least some of the structural ribs 34,38 are preferably offset or staggered with respect to one another. Arranging the structural ribs 34,38 in this manner functions to advantageously increase the net free area inside the vent body 4 at any location along the longitudinal length of the vent body 4. Accordingly, the vent body 4 and internal features thereof (e.g., structural ribs 34,38) are specifically arranged and designed to optimize the net free area and passive ventilation performance of the roof ridge vent 2. For example and without limitation, the net free area is substantially the same for a cross-section of the vent body 4 at any location along the longitudinal length of the body 4. This will be appreciated with reference to the bottom isometric view of FIG. 2 as well as the section views of FIGS. 9, 16 and 17.

Figure 7:
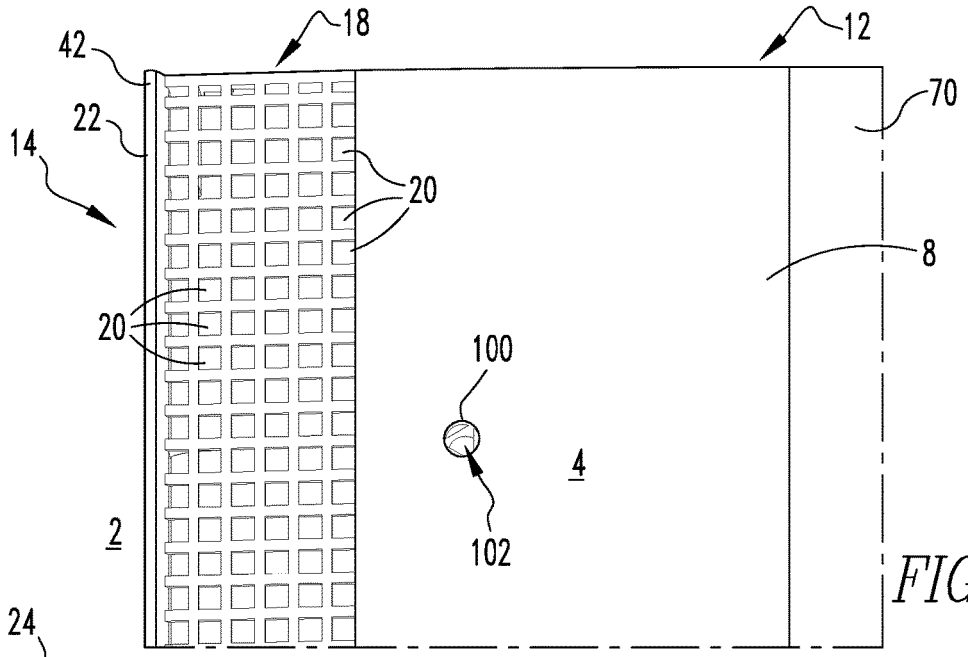
FIG. 7 is an enlarged top plan view of a portion of the vent of FIG. 5.
Figure 8:
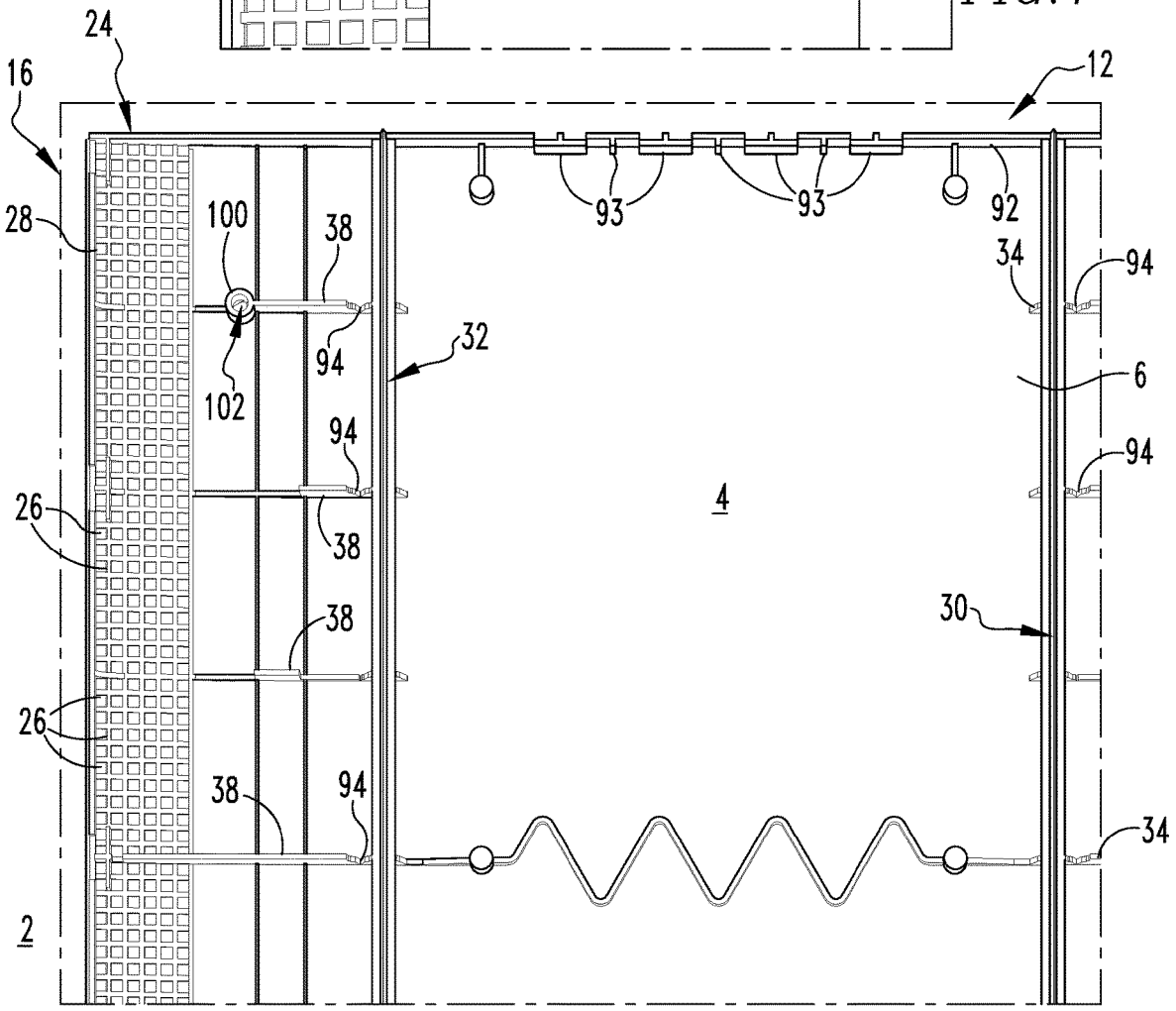
FIG. 8 is an enlarged bottom plan view of a portion of the vent of FIG. 6.

Referring to FIGS. 7 and 9, it will be appreciated that the body 4 of the example roof ridge vent 2 shown and described herein further includes a plurality of molded nail passages or tubes 100. At least some of the molded nail passages 100 include a molded engagement element 102, which is structured to engage and retain a corresponding nail 200 (shown in simplified form in phantom line drawing in FIG. 9) in a predetermined position. More specifically, prior to installation on the roof of a building (not shown) nails 200 (FIG. 9) can be partially inserted into the corresponding molded nail passages 100, as shown. This greatly simplifies the installation process for the installer. For example and without limitation, the installer no longer has to use both hands to install each nail by using one hand to hold the nail in place and the other hand to hammer it in. Rather, because the nails are already positioned and held in the correct orientation, the installer need only use one hand to hammer them in. Additionally, because the nails are already partially installed and held in place, the installer no longer has to search for and find separate nails to separately install them while on the roof. The risk of losing or missing nails is also minimized.

A still further unique aspect of the disclosed concept is that the roof ridge vent 2 it is designed to facilitate a method of nesting or closely arranging or packaging a plurality of the vents 2,2'. Specifically, as will be appreciated with reference to FIGS. 12-17, the roof ridge vent 2 includes a number of novel design features that enable two vents 2,2' to be fit together in a nesting relationship (see, for example, FIGS. 13 and 15-17) such that the combined height 80 (FIGS. 13 and 15-17) of a pair of nested vents 2,2' is less than the height 79 (FIG. 12) of one single vent 2 by itself. This capability significantly reduces the amount of space required for packaging and shipping a plurality of vents 2,2', thereby reducing associated shipping costs. Furthermore, nesting of the vents 2,2' in the arrangement shown in FIGS. 13-17 also advantageously serves to protect vent components (e.g., without limitation, elongated sealing members 30,32) during shipping. Among the features that enable this nesting capability, are a number of cutouts 94,96 (FIGS. 3, 4, 9, 10 and 14-17) and notches 98 (FIGS. 3, 10, 11, 14, 16 and 17) corresponding to the shape of certain vent body 4 features. More specifically, in the example shown, the vent body 4 includes first and second end plates 90,92 (both shown in FIG. 6) disposed at the first and second ends 10,12, respectively, of the vent body 4. At least some of the lateral protrusions 34,38 include cutouts 94 corresponding to the shape of at least a portion of the first and second elongated sealing members 30,32. Likewise, the first and second end plates 90,92 include similar cutouts 96 corresponding to the shape of at least a portion of the first and second elongated sealing members 30,32. At least one of the end plates 90,92 further includes at least one notch 98 corresponding to the shape of at least a portion of the first and second baffles 22,28.

Figure 14:
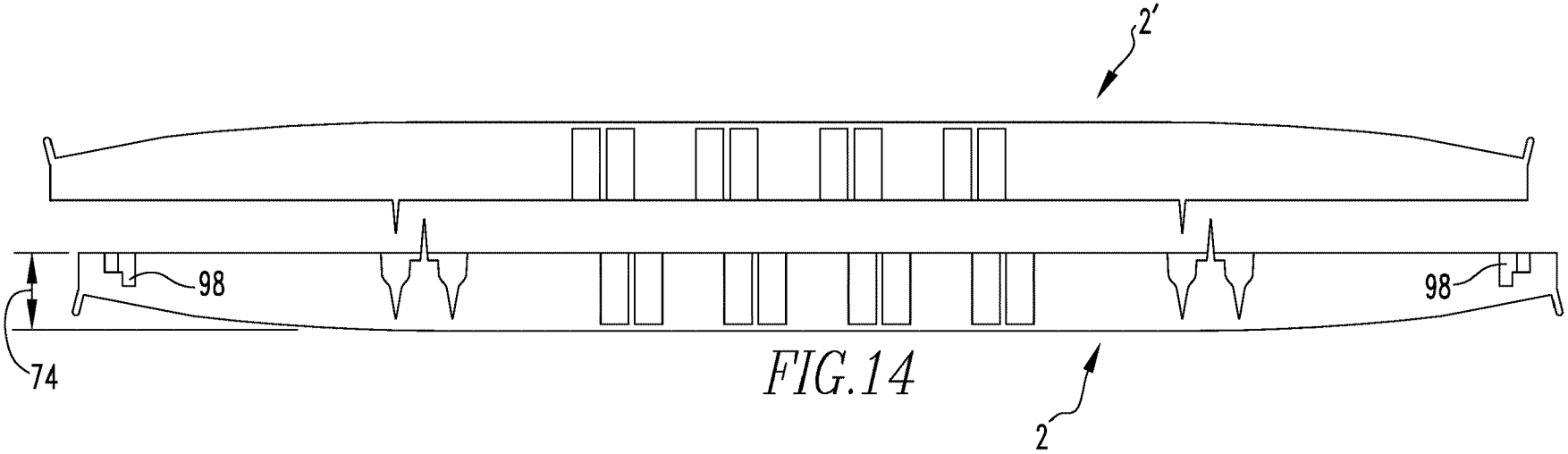
FIG. 14 is an end elevation view of two vents shown spaced apart prior to being nested together.
Figure 15:
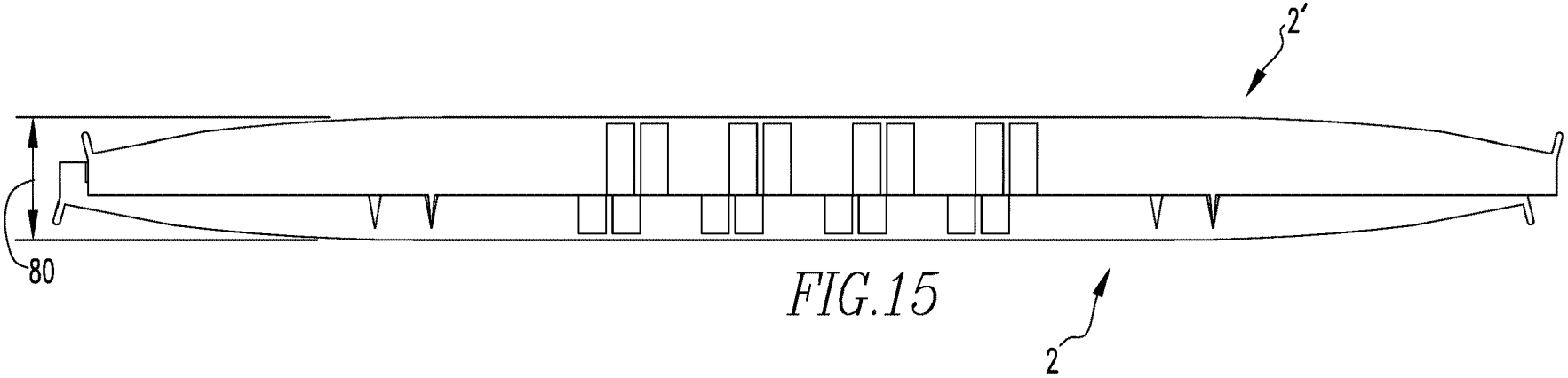
FIG. 15 is an end elevation view of the two vents of FIG. 14, shown nested together.
Figure 16:
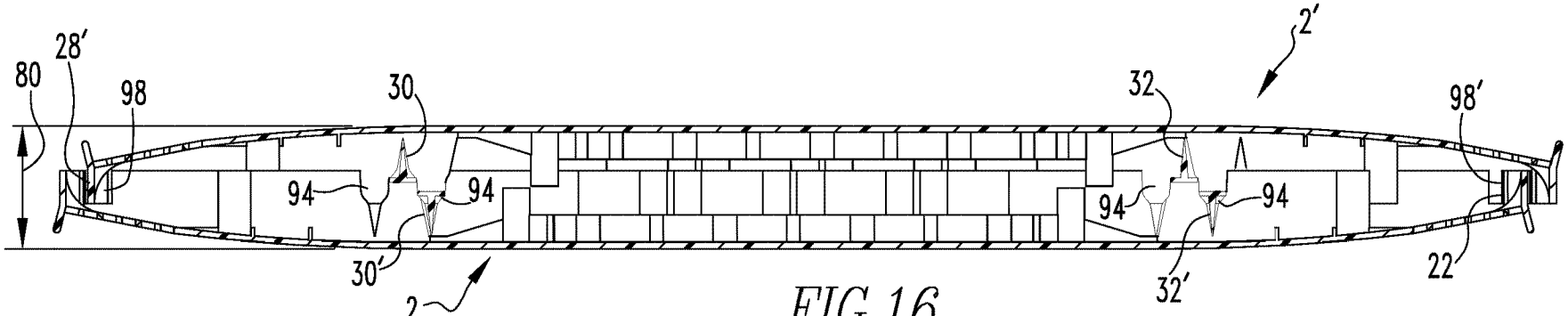
FIG. 16 is a section view taken along line 16-16 of FIG. 13.
Figure 17:
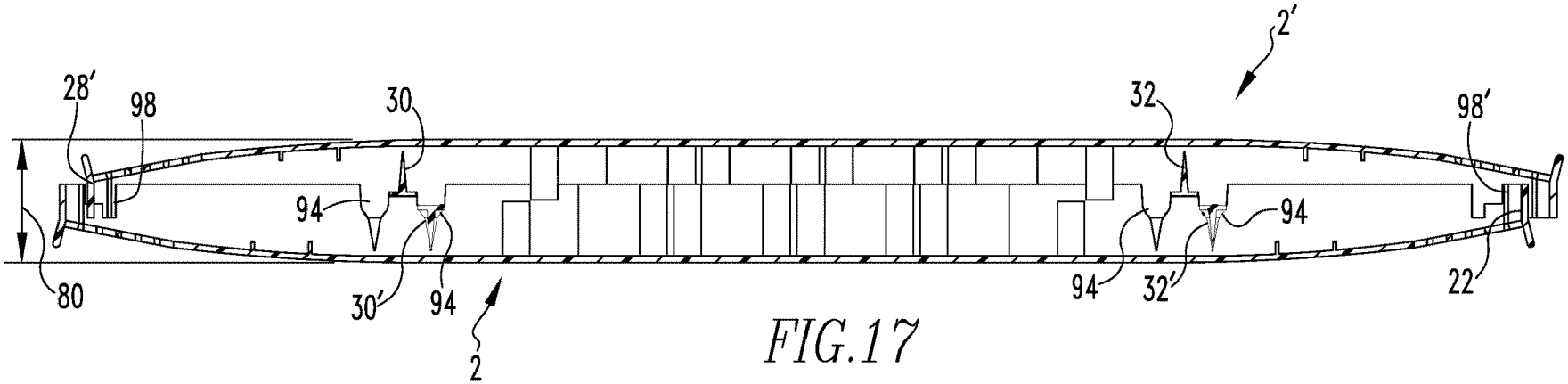
FIG. 17 is a section view taken along line 17-17 of FIG. 13.

It will be appreciated, therefore, that a method of nesting roof ridge vents 2,2' in accordance with a non-limiting embodiment of the disclosed concept preferably involves the following steps: positioning a first roof ridge vent 2 and a second roof ridge vent 2' so that the inner surfaces of the vent bodies face each other, as shown in FIG. 14; positioning the first roof ridge vent 2 to be at least one of longitudinally offset (shown in FIG. 13) and laterally offset (shown in FIGS. 15-17) from the second roof ridge vent 2'; and bringing the roof ridge vents into contact until a portion of the elongated sealing members 30,32 of the first roof ridge vent 2 are disposed in correspondingly shaped cutouts 94,96 in the opposing second roof ridge vent 2' and a portion of at least one of the baffles 22,28 of the first roof ridge vent 2 is disposed in a correspondingly shaped notch 98' in the second roof ridge vent 2', and vice versa, as shown for example in the section views of FIGS. 16 and 17.

Figure 4:
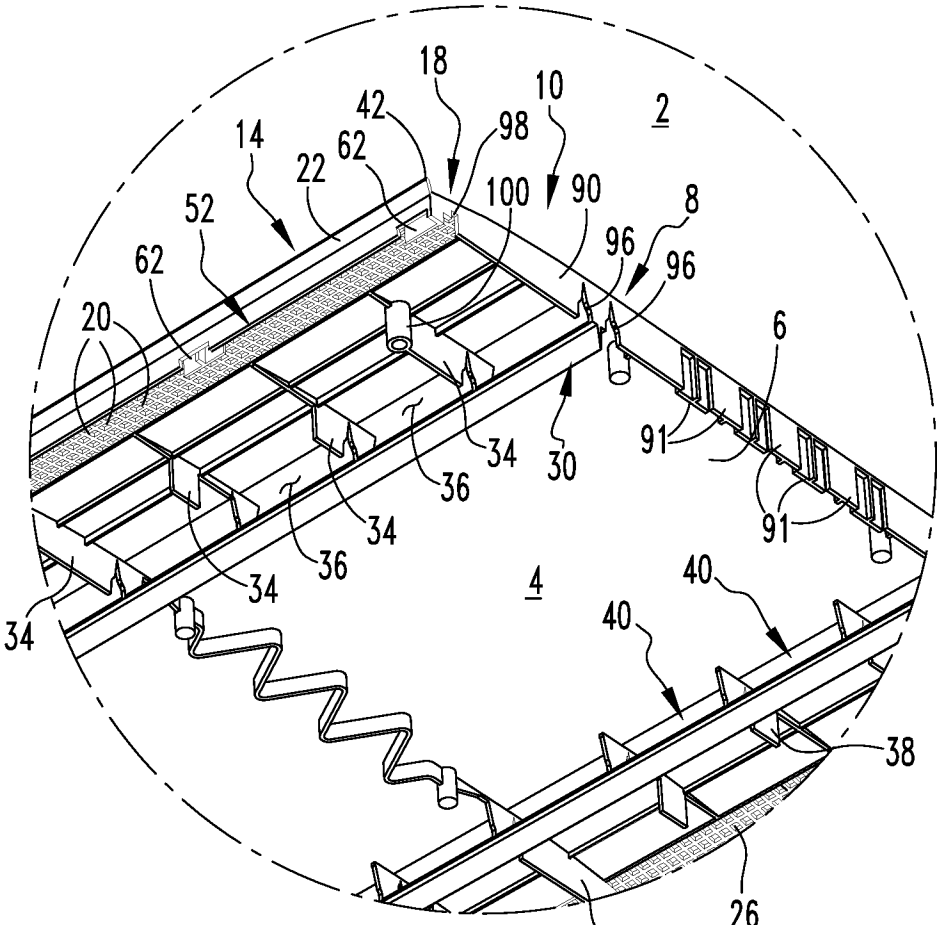
FIG. 4 is an enlarged bottom isometric view of the a portion of the vent of FIG. 2.
Figure 10:
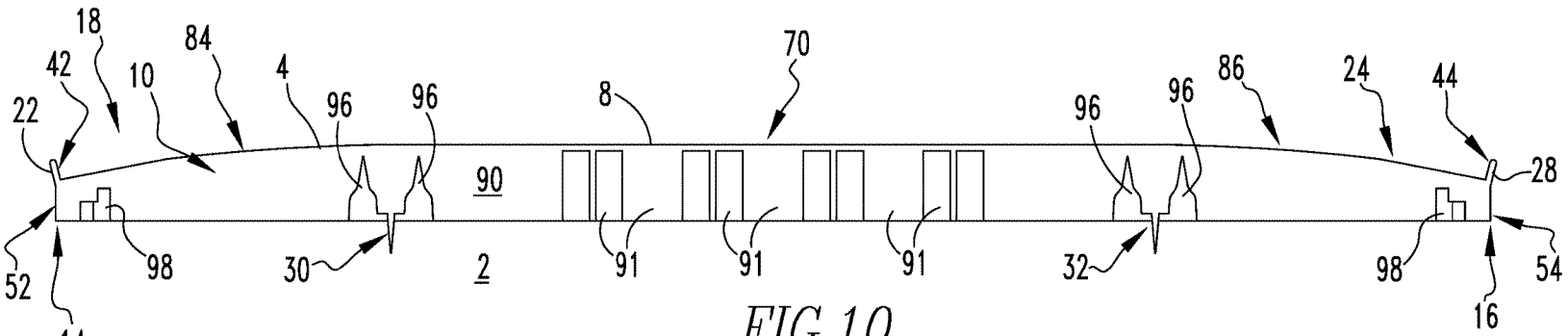
FIG. 10 is an elevation view of one end of the vent of FIG. 1.
Figure 11:
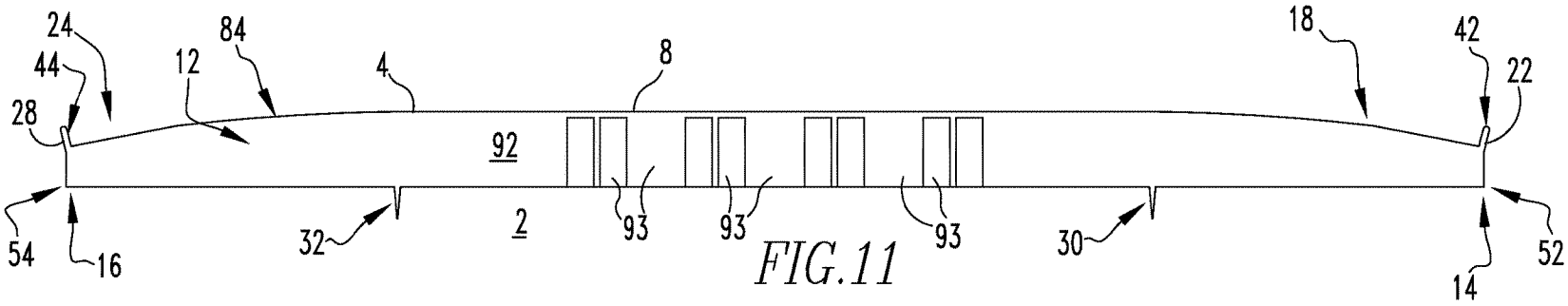
FIG. 11 is an elevation view of the opposite end of the vent of FIG. 10.
Figure 12:
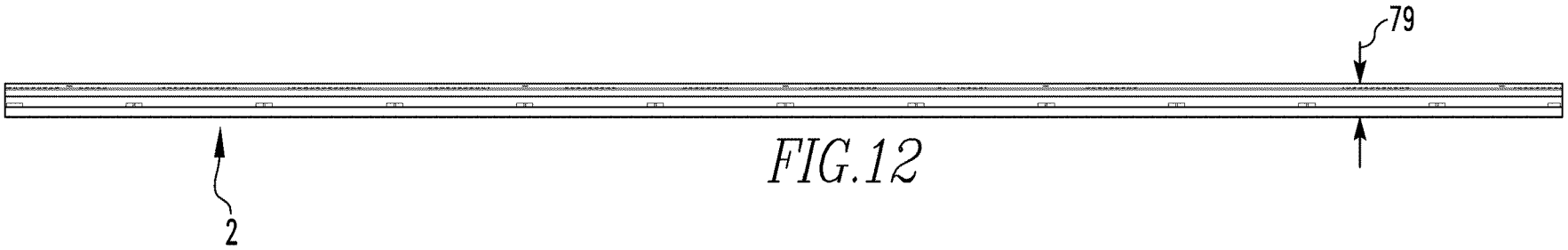
FIG. 12 is a side elevation view of the vent of FIG. 1.
Figure 13:
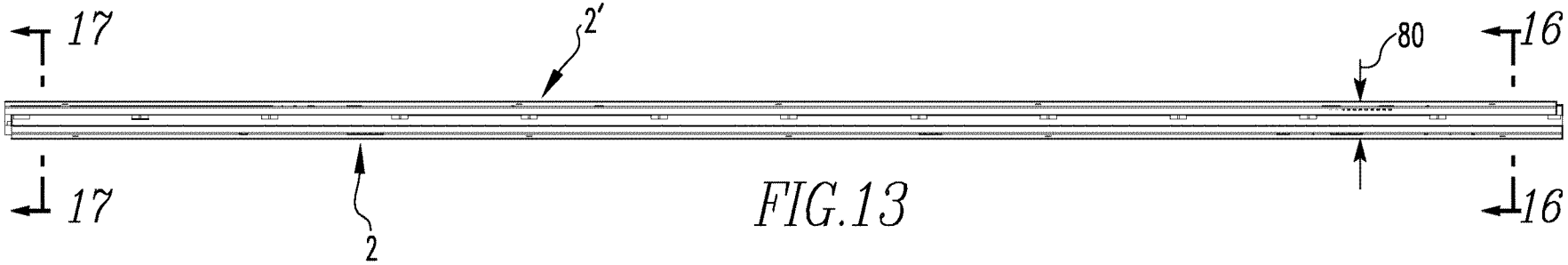
FIG. 13 is a side elevation view showing two vents nested together, in accordance with an embodiment of the disclosed concept.

As shown in FIGS. 4, 10 and 11, the end plates 90,92 preferably further include a plurality of separate tabs 91,93, respectively, which are staggered or offset, as best shown in the enlarged isometric view of FIG. 4. This arrangement allows the end plates 90,92 and, therefore, the vent body 4 to flex or bend. That is, the separate tabs 91,93 are structured and arranged such that portions of the separate tabs 91,93 will overlap to allow the vent body 4 to flex and bend to correspondence to the shape of a building roof (not shown), as needed, while still providing an effective barrier, as desired.

Accordingly, the disclosed concept provides a novel roof ridge vent 2 and associated method of nesting roof ridge vents 2,2' with many advantages over the prior art.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A roof ridge vent comprising:

a body comprising an inner surface, an outer surface disposed opposite the inner surface, a first end, a second end disposed opposite and distal from the first end, a first side, and a second side disposed opposite and distal from the first side;

a first edge portion disposed at or about the first side, the first edge portion including a plurality of first vent openings for the passage of air and a first baffle for shielding the first vent openings;

a second edge portion disposed at or about the second side, the second edge portion including a plurality of second vent openings for the passage of air and a second baffle for shielding the second vent openings; and a central portion disposed between the first edge portion and the second edge portion, the central portion having a first height, wherein the body further comprises a first tapered portion between the first edge portion and the central portion, a second tapered portion between the second edge portion and the central portion, and a plurality of molded nail passages, wherein the first tapered portion tapers or gets narrower as it extends laterally outward from a location inboard the molded nail passages proximate the central portion to the first edge portion and the second tapered portion tapers or gets narrower as it extends laterally outwardly from a location inboard the molded nail passages proximate the central portion to the second edge portion such that the body gets thinner as it extends laterally outwardly from the central portion and the first and second edge portions have a reduced height compared to the first height of the central portion.

2. The roof ridge vent of claim 1 wherein the plurality of first vent openings and the plurality of second vent openings are arranged in a repeating geometric pattern.

3. The roof ridge vent of claim 2 wherein the repeating geometric pattern is a plurality of substantially identical square vent openings; and wherein each of the square vent openings has a cross-sectional area of about 0.016 square inches.

4. The roof ridge vent of claim 1 wherein the first vent openings and the second vent openings are large enough to provide desired airflow yet small enough to eliminate the requirement of a separate screen or filter element in order to resist undesired entry of debris.

5. The roof ridge vent of claim 1 wherein the first baffle and the second baffle extend longitudinally from the first end of the body to the second end of the body; wherein the first baffle has a first tip extending upward and laterally outward with respect to the body; wherein the second baffle has a second tip extending upward and laterally outward with respect to the body; and wherein the first tip and the second tip are rounded to increase laminar airflow.

6. The roof ridge vent of claim 5 wherein the first baffle has a first base dispose opposite the first tip; wherein the second baffle has a second base disposed opposite the second tip; and wherein the first base and the second base each include a plurality of drainage holes.

7. The roof ridge vent of claim 1 wherein the first and second edge portions are generally planar and are disposed at an angle to further taper the body to the reduced height.

8. The roof ridge vent of claim 1 wherein the body further comprises a plurality of first lateral protrusions extending outwardly from the inner surface of the body at or about the first edge portion and plurality of second lateral protrusions extending outwardly from the inner surface of the body at or about the second edge portion; wherein the first and second lateral protrusions comprise a plurality of structural ribs; and wherein the structural ribs are offset with respect to one another to increase the net free area inside the body.

9. The roof ridge vent of claim 8 wherein the body further comprises a first elongated sealing member and a second elongated sealing member; wherein each of the first elongated sealing member and the second elongated sealing member extends longitudinally substantially between the first end of the body and the second end of the body; wherein the first elongated sealing member transversely spans a number of the first lateral protrusions thereby forming an air gap between the first elongated sealing member and the inner surface of the body; and, wherein the second elongated sealing member transversely spans a number of the second lateral protrusions thereby forming an air gap between the second elongated sealing member and the inner surface of the body.

10. The roof ridge vent of claim 1 wherein the vent is a single unitary component formed from one single piece of material.

11. The roof ridge vent of claim 10 wherein the single unitary component is an injection molded piece; and wherein the injection molded piece is formed in one single manufacturing step.

12. The roof ridge vent of claim 1 wherein the net free area is substantially the same for a cross-section of the body at any location along the longitudinal length of the body.

13. The roof ridge vent of claim 1 wherein at least some of the molded nail passages include a molded engaging element structured to engage and retain a corresponding nail in a predetermined position.

14. The roof ridge vent of claim 1 wherein the body further comprises a first elongated sealing member and a second elongated sealing member; wherein each of the first elongated sealing member and the second elongated sealing member extends longitudinally substantially between the first end of the body and the second end of the body; wherein the body further comprises a first end plate disposed at the first end and a second end plate disposed at the second end; and wherein at least one of the first end plate, the second end plate, a number of the first lateral protrusions, and a number of the second lateral protrusions includes a cutout corresponding to the shape of a portion of the first and second elongated sealing members.

15. The roof ridge vent of claim 14 wherein the vent is a single unitary component formed from one single piece of material.

16. The roof ridge vent of claim 15 wherein the single unitary component is an injection molded piece; and wherein the injection molded piece is formed in one single manufacturing step.

17. The roof ridge vent of claim 1 wherein the plurality of first vent openings and the plurality of second vent openings are oriented vertically when the roof ridge vent is viewed from an end elevation perspective.

* * * * *